United States Patent [19]

Cohn

[11] 4,146,040

[45] Mar. 27, 1979

[54] CIGARETTES

[76] Inventor: Charles C. Cohn, c/o Colonial Alloys Company 4041 Ridge Ave., Bldg. #11, Philadelphia, Pa. 19129

[21] Appl. No.: 778,665

[22] Filed: Mar. 17, 1977

[51] Int. Cl.[2] ..... A24D 1/02

[52] U.S. Cl. ..... 131/4 A; 131/8 R; 131/8 A; 131/10 R; 131/15 A; 131/10.7

[58] Field of Search ..... 131/4 A, 8 A, 15, 17, 131/10.9, 8 R, 9, 10 R, 11; 6/10.7

[56] References Cited

U.S. PATENT DOCUMENTS

| | | | |
|---|---|---|---|
| 1,798,537 | 3/1931 | Honigbaum | 131/4 A |
| 1,996,002 | 3/1935 | Seaman | 131/4 A |
| 2,718,889 | 9/1955 | Claussen | 131/4 A |
| 2,766,148 | 10/1956 | Rowland | 131/17 R |
| 3,030,963 | 4/1962 | Cohn | 131/15 A |
| 3,368,566 | 2/1968 | Avedikian | 131/10.9 |
| 3,581,748 | 6/1971 | Cameron | 131/11 |
| 3,861,403 | 1/1975 | Vinals et al. | 131/15 R |
| 3,878,850 | 4/1975 | Gibson et al. | 131/17 R |
| 4,006,749 | 2/1977 | Horowitz | 131/15 R |

FOREIGN PATENT DOCUMENTS

| | | | |
|---|---|---|---|
| 908439 | 10/1962 | United Kingdom | 131/17 R |
| 1214319 | 10/1970 | United Kingdom | 131/10.7 |

OTHER PUBLICATIONS

*Low Tar-Nicotine Content Design,* by Dr. Samfeld, pp. 26 & 28, cited, published in Tobacco Magazine, 9/28/1973.

*Primary Examiner*—Robert W. Michell
*Assistant Examiner*—V. Millin
*Attorney, Agent, or Firm*—Harding, Earley & Follmer

[57] ABSTRACT

A fire resistant cigarette has a wrapper having a coating applied as a dual treatment comprising the separate steps of coating the wrapper with a solution of an alkali metal silicate and coating the wrapper with a pH lowering material wherein the pH lowering material lowers the pH of the alkali silicate. The dual treatment of the cigarette is such that when the cigarette is smoked it produces a smoke which has a pleasing taste and the cigarette is fire resistant.

14 Claims, 3 Drawing Figures

CIGARETTES

BACKGROUND AND SUMMARY OF THE INVENTION

This invention relates to cigarettes or the like which have been treated with alkali silicates to make them fire resistant. The prior art comprises a number of patents which disclose cigarettes treated with silicates, for example, U.S. Pat. Nos. 1,905,416; 2,049,320; 2,985,175; 3,006,347; 3,030,963; and 3,220,418.

It is known that the pH of cigarette smoke greatly influences its taste. Fire resistant cigarettes of the indicated type when smoked produce a smoke which has an undesirable taste generally involving a harsh bite or a soapy taste.

Simply adding an acid or other additive to the alkali silicate solution of fire resistant cigarettes of the indicated type does not provide a satisfactory solution to the problem. The addition of the acid tends to cause the silicate to precipitate and form a gel by reaction with the $SiO_2$ of the silicate solution. The resulting gel cannot be satisfactorily applied to the cigarette wrapper.

Accordingly, it would be desirable to provide a free resistant cigarette of the indicated type which produces a smoke that does not have the undesirable taste resulting from the alkalinity of the silicate. It is the general object of this invention to provide such a fire resistant cigarette and a method of making the same.

Briefly stated, the general object of the invention is achieved by the provision of a cigarette or the like which has a flammable wrapper surrounding a body of tobacco, which wrapper has a coating which includes a quantity of an alkali silicate applied as one treatment of the wrapper. In accordance with a preferred embodiment of the invention, a quantity of a pH lowering material is applied as another coating treatment of the wrapper. The dual treatment coating contains quantities of the alkali metal silicate and the acid producing material to make the cigarette fire resistant and to treat the combustion products of the cigarette so as to produce a pleasant smoke. The dual treatment coating in accordance with the invention does not impair the fire resistance imparted to the cigarette by the silicate coating; in fact, the coating of acid producing material, in some instances, may improve the fire resistance of the cigarette.

DESCRIPTION OF THE PREFERRED EMBODIMENTS

Figure 1:
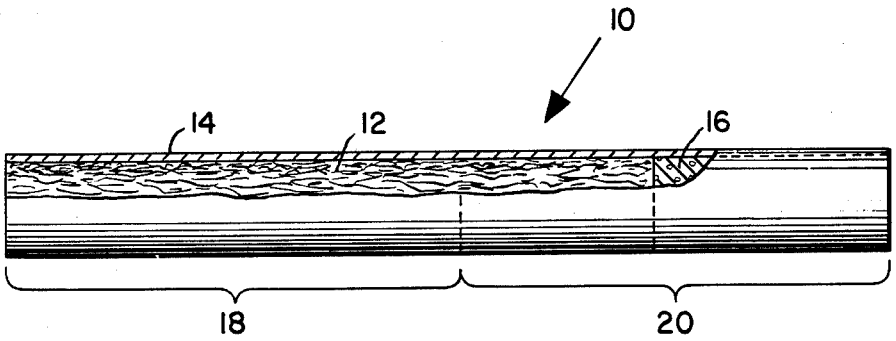
FIG. 1 is a view of a cigarette in accordance with one embodiment of the invention.

The invention is applicable to a cigarette structure in which the conventional tobacco filler is wrapped in a paper or a similar flammable wrapper. The invention is also applicable to cigarettes of various lengths, with or without filters or where combustible materials other than tobacco are used. Also, the invention is applicable to the "little cigars" in use today. Accordingly, the term "cigarettes" as used herein is to include the above described types of smoking articles.

In accordance with the invention, the wrapper of the cigarette is provided with a coating which is responsive to the heat of a burning cigarette to provide a fire resistant cigarette. The term "fire resistant cigarette" as used herein is defined as a cigarette which will not cause ignition of a mattress after the cigarette is lit and one minute is allowed to elapse before the cigarette is placed on the ticking of the mattress, which mattress is made of cotton ticking and cotton batting. This is essentially the test set forth in the Flammable Fabrics Act and designated Test No. DOC-FF-4-72.

In accordance with the invention, the cigarette wrapper is provided with a quantity of a pH lowering material to treat the combustion products of the cigarette to produce a pleasant smoke. The term "pH lowering material" as used herein includes acids or other materials which when applied to the cigarette wrapper acts on the smoke to produce a pleasant smoke. The term "pleasant smoke" as used herein is defined as a smoke which is such that the taste is satisfactory to the smoker as opposed to the alkaline smoke which is displeasing. While the taste of a cigarette might appear to be rather subjective, the fact is that a "pleasant smoke" is readily discernable by smokers in general and particularly by professional cigarette testers.

In accordance with the invention, the cigarette wrapper of the cigarette is provided with a coating which is applied as a dual treatment. In accordance with a preferred embodiment, one coating treatment involves the application of a coating of an alkali metal silicate and the other treatment involves the application of a pH lowering material. The sequence of treatments is reversible, i.e., either the silicate or the pH lowering material may be applied first.

It is to be noted that the coating may be applied to the wrapper in various configurations. Preferably, the coating is applied over the entire wrapper although it may also be applied along spaced parallel lines running the length of the cigarette or it may be applied as sinuous lines or as dots. Accordingly, the term "coating" as used herein is to include the various configurations described above.

It is noted that there are about 150 brands of cigarettes. The various brands burn at different rates and thermal intensity so as to require different concentrations of the alkali metal silicate to make them fire resistant and also different quantities of the pH lowering material to achieve the desired taste. Moreover, all cigarettes of a particular brand are not exactly the same in their burning or thermal properties. Accordingly, no specific limitations can be placed on the concentrations of the alkali metal silicate or the quantity of the pH lowering material.

The following examples of cigarettes in accordance with the invention illustrate preferred embodiments of the invention:

EXAMPLE 1

The first step is to coat one side of the entire wrapper of a cigarette with an aqueous solution of 1 part of "0" type of silicate to 7 parts of water (by volume) and to dry the coating.

The second step is to coat the silicate coated wrapper with an aqueous solution of 30 cc. per liter of 85% $H_3PO_4$ (by volume) and to dry the coating.

The coating steps are carried out by any of a number of methods of coating paper such as by means of a wet roller. Since the applied solution will penetrate the paper wrapper, which is thin and porous, it may be applied to either side thereof. Moreover, the solution may be applied to a finished cigarette or to the wrapper paper prior to forming the cigarette.

EXAMPLE 2

The same as Example 1 except that the order of the first and second steps are reversed.

In Examples 1 and 2, the acid treatment involves the use of a phosphoric acid. It is noted that other acids or ammonium compounds may also be used. For example, sulfuric acid may be used. An example of the use of sulfuric acid is set forth below.

EXAMPLE 3

The first step is to coat one side of the entire wrapper of a cigarette with an aqueous solution of 1 part of "0" type of silicate to 7 parts of water (by volume) and dry the coating.

The second step is to coat the dried silicate coated wrapper with an aqueous solution of 1 part of 66°Bé $H_2SO_4$ plus 50 parts of water (by volume) and then dry the coating.

In Examples 1, 2, 3 and 4 above, a typical composition of "0" type of silicate is that furnished by the Philadelphia Quartz Company which is described below:

| | |
|---|---|
| Viscosity (poises) | 4.0 |
| Baumé | 42° |
| % $SiO_2$ (Wt.) | 29.5 |
| % $H_2O$ (Wt.) | 61.3 |
| % $Na_2C$ (Wt.) | 9.2 |
| Ratio of $SiO_2$ : $Na_2O$ | 3.2:1 |

EXAMPLE 4

The same as Example 2 except that the order of the first and second steps are reversed.

An example of a cigarette in accordance with the invention in which the alkalinity of the silicate film was reduced with an acid producing material is set forth below:

EXAMPLE 5

The first step comprised coating one side of the entire wrapper of a cigarette with a solution containing 100 g/l of ammonium sulfate and dryng this coating.

The second step comprised treating the coating with an aqueous solution containing 1 part of "0" type silicate to 9.7 parts (by volume) of water, after which the wrapper was dried.

An example of a cigarette in accordance with the invention involving the use of colloidal silica solutions to produce the fire resistance is set forth below:

EXAMPLE 6

A Carlton filter cigarette was first provided with a coating on its wrapper by treatment with a solution of colloidal silica supplied by the Monsanto Chemical Company (under the tradename "SYTON") after which the coating was dried. Colloidal silica is essentially composed of silica in the sub-micron range size in water, which silica, because of its size, acts like it is in solution. Thus, the sub-micron size particles of silica do not settle out.

A second step comprised the treatment of the cigarette wrapper with a solution of 50 grams per liter of water of diammonium phosphate after which the coating was dried.

Another example of the dual treatment of the cigarette paper wherein the aqueous solution of an acid used is a weak organic acid is as follows:

EXAMPLE 7

A Kent deluxe filter cigarette was first treated by applying to its wrapper a 14.3% (by volume) of "0" silicate after which it was dried. This wrapper was then treated with a 0.5% (by volume) of glacial acetic acid and dried.

An example of the use of water soluble lignosulfonates as one of the treatments of the cigarette paper is as follows:

EXAMPLE 8

The wrapper of a Kent deluxe filter cigarette was first treated by coating it with a 14.3% (by volume) solution of "0" silicate and then drying the coating. The wrapper was then treated by coating over the dried silicate with an aqueous solution of 10 g/l of calcium lignosulfonate and dried. The lignosulfonate used has a pH of about 4.4.

An example of a basic formulation which is satisfactory for various brands of cigarettes is set forth in the next example.

EXAMPLE 9

The wrapper of the cigarette was first coated with an aqueous solution containing from about 20 to about 22% (by volume) of "0" type of silicate and then dried.

The second step comprised coating over the silicate treated wrapper with an aqueous solution of 0.5% (by weight) of sugar after which the coating was dried.

All of the cigarettes treated as set forth in the foregoing Examples had the following advantages and properties:

(1) Slower burning between puffs, resulting in more puffs per given length of the cigarettes;
(2) Lower "tars", nicotine and carbon monoxide and other gases based on the same amount of puffs as in an untreated cigarette of the same brand;
(3) Stiffer and less likely to bend or be crushed;
(4) Lower in cost when comparisons are made on the same amount of puffs (considerably less tobacco is consumed);
(5) Considerably less "tars", nicotine and gases, between puffs, during free burning;
(6) Fire resistance based on the Federal test method DOC-FF-4-72 (Flammable Fabrics Act);
(7) Equivalent or improved taste over cigarettes treated with alkali solutions used to impart fire resistance to the cigarettes;
(8) Retention of ashes and the insulation of the hot coal;
(9) Cooler, non-glowing smoldering butt;
(10) Much less smoke between puffs;
(11) The ability to materially increase the filter length of a given length of cigarette by reducing the tobacco rod length to a length which yields the same amount of puffs as a normal full length tobacco rod. Since the last few puffs of a regular untreated cigarette brings the hot coal close to the smoker's mouth, resulting in hot puffs very high in "tars" and nicotine, the lengthening of the filter by this invention makes it possible to keep the coal a considerable distance from the smoker's mouth resulting in relatively cool final puffs containing less "tar" and nicotine.

Other advantages of cigarettes in accordance with the invention will appear hereafter.

With respect to the property of fire resistance as listed in (6) above, it is to be noted that cigarettes burn hotter as the ash approaches the filter end. Therefore, a cigarette which is to be made fire resistant for its full length requires a greater concentration of silicate than a cigarette that is to be made fire resistant for one-half or three-quarters of its length. This must be taken into account in the selection of the silicate concentration.

With respect to the property of ash retention and hot coal insulation listed in (8) above, it is to be noted that the retention of ashes results in less loose ashes on rugs, furniture, clothes, etc. The insulation of the hot coal results in less danger of skin burns by contact with a burning cigarette and the reduced danger of inflammation or charring of fabric materials as a result of contact with a burning cigarette or a separated coal, when, for example, a burning cigarette is dropped.

Other acids that may be used as pH lowering materials are acetic, hydrochloric, sulfamic, boric, citric, tartaric, formic and tannic.

Other lignosulfonates that may be used as pH lowering materials are sodium lignosulfonate and ammonium lignosulfonate.

Other pH lowering materials that may be used as sodium bisulfate and sugar, including sucrose, fructose, lactose, maltose and glucose.

It is noted that the ultimate composition of the dual treatment coating of the invention is not known. Accordingly, this coating is best described and claimed in terms of product by process terminology.

The double treatment of the cigarette as set forth in many of the above Examples not only improves the taste of the cigarette but also makes it possible to make cigarettes fire resistant that were not fire resistant when treated with certain concentration of "0" silicate alone.

In the case of the dual treatment coating, the pH of the double treated wrapper when soaked in a small amount of water (hydrion pH paper) is in the range from about 9.0 to about 4.5. Specifically, the test procedure for determining the pH of the wrapper comprises taking about one square inch of paper and placing it in a watch glass to which is added 2–3 c.c. of water. Hydrion pH paper is then immersed in the water in the watch glass for about one to five minutes. The hydrion paper is then removed and its color is compared with a standard color chart to determine the pH.

It is well settled that the satisfaction derived from smoking is mainly due to the pharmacological effects of nicotine and the lower lung cancer incidence in cigar and pipe smokers may be related to the fact that the nicotine is more readily absorbed in the form of the free base at alkaline pH than in the form of a stable salt, at acid pH.

As is stated in an article entitled "The Sugar Content and the pH of the Smoke of Cigarettes, Cigar, and Pipe Tobaccos in Relation to Lung Cancer" appearing in the International Journal of Cancer, May 15, 1972 at pp. 666–675, in order to obtain the same degree of "nicotine satisfaction" as in smoking a pipe or cigar, a smoker of cigarettes giving up acid smoke would tend to smoke more and to encourage more prolonged and extensive contact of the smoke with the mouth and bronchus, and to take the smoke into his lungs, which would thus suffer greater exposure to the "carcinogenic" effect of the smoke than would be the case with cigar and pipe smokers. The addition of substances that give rise to an alkaline vapor in the usual temperature of combustion of cigarettes has been shown to reverse the character of the smoke of certain tobacco so that it then resembles that of cigar and pipes in becoming progressively more alkaline during the course of smoking.

The cigarette in accordance with the invention can readily be made to vary the pH of the smoke as desired. This is achieved by means of the dual treatment of the wrapper wherein the wrapper is first treated with a material that produces a smoke of high pH (the silicate treatment to produce fire resistance), which treatment is followed by a second treatment of the wrapper with a pH lowering material to result in a compound, which, when subjected to the heat of combustion of a burning cigarette, modifies the smoke stream of the cigarette to produce a pleasant taste. In general, it is desirable to use not more than a sufficient quantity of a pH lowering material to bring the smoke to an acceptable level from the standpoint of taste. Thus, the cigarette in accordance with the invention has another advantage in that the nicotine content of the smoke can be controlled to produce a safer cigarette from a health viewpoint.

The feature of the invention whereby the coating of the cigarette results in more puffs per length of cigarette permits the production of the novel cigarette shown in FIG. 1. In this figure, a cigarette 10 comprises a tobacco filler 12 and a filter tip 16 enclosed by a combustible wrapper 14. The cigarette 10 has the dimensions of a standard size cigarette. Only a portion of the wrapper 14 is coated by means of the dual treatment of the invention, this coated portion being indicated at 18. The coating of the wrapper portion 18 is designed so as to yield a desired amount of puffs of the cigarette 10, such as the amount of puffs of a typical standard size cigarette, by consuming the tobacco within the wrapper portion 18. The remaining wrapper portion 20 is coated with a solution to make it non-burning, portion 20 is coated with a solution to make it non-burning. For example, wrapper portion 20 may be coated with a 50% (volume) "0" type of silicate used in the examples of the invention given above or it may be provided with a burning barrier of a type known in the art, such as the burning barriers shown and described in U.S. Pat. No. 1,996,002.

Figure 1A:
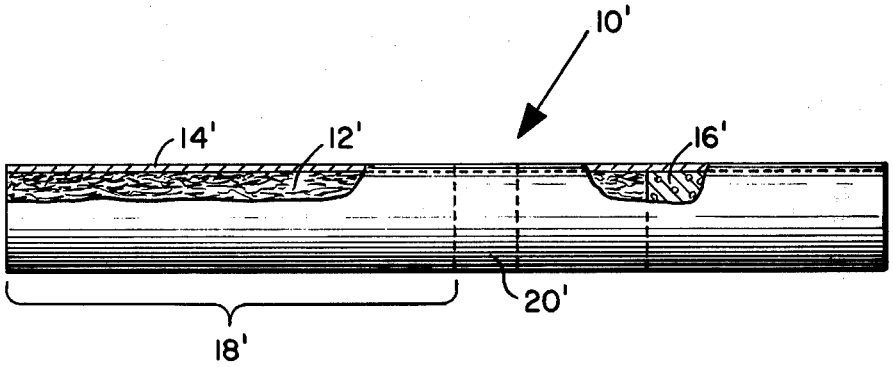
FIG. 1A is a view of a cigarette in accordance with another embodiment of the invention.

In FIG. 1A, there is shown a cigarette 10' similar to the cigarette 10 wherefore corresponding parts have been given the same reference numerals with primes added. The only essential difference between cigarette 10 and cigarette 10' is the form of the burning barrier. Thus, cigarette 10' comprises a tobacco filler 12' and a filter tip 16' enclosed by a combustible wrapper 14'. A portion of the wrapper 14' is coated by means of the dual treatment of the invention, this coated portion being indicated at 18'. The coating of the wrapper portion 18' is designed so as to yield a desired amount of puffs of the cigarette 10' such as the amount of puffs of a typical standard size cigarette, by consuming the tobacco within the wrapper portion 18'. Adjacent the wrapper portion 18', a band area 20' extending circumferentially around the wrapper 14' is coated with a solution to make it non-burning in the same manner as the wrapper portion 20 of cigarette 10. The width of the band area 20' may be relatively narrow so as to cause the cigarette to extinguish when it is not being puffed and the cigarette has burned up to the barrier provided at the band area 20' and such that a smoker may, if he so desires, puff hard to cause the cigarette to continue to burn over the barrier. As an alternate design, the width of the band area 20′ may be selected to be such that the cigarette cannot burn beyond a given length even if it is puffed. The selection of the width of the band area 20′ depends on the result desired by the manufacturer.

The form of the invention shown in FIGS. 1 and 1A permits the application of the novel dual treatment of the invention to any of the standard brands of cigarettes in use today and produces a safer cigarette healthwise because the non-burning tobacco rod portion within the wrapper portion 20 serves as an additional filter to aid the regularly provided filter, such as is indicated by filter 16.

Figure 2:
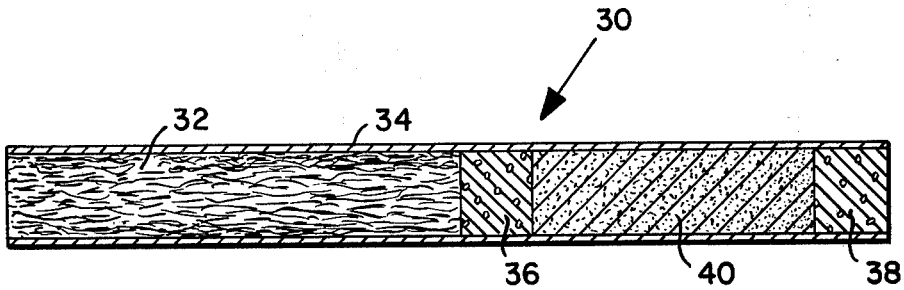
FIG. 2 is a view of a cigarette in accordance with still another embodiment of the invention.

The feature of the invention whereby the coating on a cigarette results in more puffs per length of cigarette also permits the production of the novel cigarette shown in FIG. 2. In FIG. 2, a cigarette 30 comprises a tobacco filler 32 enclosed by a combustible wrapper 34. The wrapper 34 also encloses a filtering section comprising two short filter plugs 36 and 38 between which is located a long column of a gas filtering medium 40, such as activated carbon, alumina or the like. The filter plugs 36 and 38 may be made of cellulose acetate as is conventional in the art.

The portion of the wrapper 34 enclosing the tobacco filler 32 is coated by means of the dual treatment of the invention as described above. The coating is designed such as to yield a desired amount of puffs, such as the same amount of puffs of a conventional cigarette.

It has been determined by researchers that the filtering of the gases produced by the smoking of a cigarette is very important to improve the safety of the cigarette healthwise. It has been determined that various cigarettes in use today, both of the low tar and low nicotine filter brands, produce harmful gases. The cigarette 30 is constructed so as to filter out a large amount of these harmful gases by reason of the provision of the long filter section which can accommodate a long column filtering medium 40. It would be impractical for present day cigarettes to accomplish the gas filtering results of cigarette 30 since it would be necessary to lengthen their filter, which would make the cigarette longer than its standard length of 85 millimeters. Also, a typical 120 millimeter cigarette would become impractically long if the filter were lengthened by the amount the filter is lengthened pursuant to this invention. For example, a regular 85 millimeter untreated cigarette would have to add about 18 millimeters in length to provide a gas absorbing material taking into account that two 6 millimeter regular filter plugs have to be used at each end of the gas filtering medium. This would make the cigarette over a 100 millimeters in length which would be impractical. On the other hand, with the cigarette 30 of the invention the 24 millimeter length of gas absorbing material and the two 6 millimeter plugs amounts to only 36 millimeters which can then be combined with a 49 millimeter tobacco rod producing a standard length cigarette of about 85 millimeters in length. This dimensional arrangement is shown in FIG. 2 wherein the tobacco rod portion 32 may be 49 millimeters in length and by reason of the coating of the invention can provide as many puffs as a 67 millimeter tobacco rod of a typical 85 millimeter conventional cigarette.

It is to be noted that the longer gas absorbing filtering section could also serve to remove more "tars" and nicotine than a conventional shorter length filter.

By applying the principles of the invention to standard brand cigarettes, the number of puffs per length can be increased as much as 180%. In this determination, the number of puffs is measured in accordance with standard U.S. Government test procedures in which the measurement of the number of puffs of a cigarette is based on one puff per minute of 35 milliliters per puff at the standard pressure drop (draw).

Another advantage of the cigarette treatment in accordance with the invention is that the volume of smoke given off during free burning (i.e. between puffs) is much less than with untreated cigarettes. Treated cigarettes give off faint to very light volume of smoke which is not noxious to a person in the immediate vicinity of the smoker, whereas untreated cigarettes emit voluminous noxious smoke.

Also, while almost all standard brand cigarettes in use today permit the flicking off of ash during the smoking of a cigarette, cigarettes treated in accordance with the invention hold the ash considerably longer.

Another important advantage of the invention is that when paper to be used in the making of cigarettes is coated by means of the dual treatment of the invention, the silicated layers of paper on a bobbin will not stick together and there will be no other sticking-related problems in the cigarette making machine. Previous silicate coated papers had such sticking-related problems in the manufacture of cigarettes.

I claim:

1. A cigarette or the like comprising:
a body of tobacco,
a filtering section adjacent said body of tobacco, said filtering section including a long column of a gas filtering medium,
a flammable wrapper surrounding said body of tobacco,
a coating on said wrapper,
said coating including a quantity of an alkali metal silicate applied as one treatment of the wrapper,
and a quantity of pH lowering material applied as another treatment of the wrapper so as to lower the pH of the alkaline silicate
said dual treatment coating containing quantities of said alkali metal silicate and said pH lowering material to make the cigarette fire resistant and to treat the combustion products of the cigarette to produce a pleasant smoke.

2. A cigarette according to claim 1 wherein said filtering section includes a filter plug at each end of said gas filtering medium.

3. A cigarette according to claim 2 wherein said filtering section extends for at least about one-third of the length of the cigarette and said cigarette is of a standard length of approximately 70–120 millimeters.

4. A method of making a cigarette or the like comprising a body of tobacco surrounded by a flammable wrapper which method comprises:
coating the wrapper in a dual treatment,
said dual treatment coating including applying a solution of alkali metal silicate to the wrapper as one treatment and applying a solution of a pH lowering material as another treatment to lower the pH of the alkaline silicate.

5. The method of claim 4 in which said pH lowering material is applied in a quantity to lower the pH of the wrapper to a range of from about 9.0 to about 4.5.

6. The method of claim 4 in which said metal alkali silicate is applied as a solution of "0" type silicate in which the ratio of $SiO_2$: $Na_2O$ is 3.2 to 1.

7. The method of claim 4 in which said pH lowering material is applied as a solution of diammonium phosphate.

8. The method of claim 4 wherein said coating on said wrapper is applied over only a first portion of the length of the cigarette, said first portion extending from the tobacco end of the cigarette.

9. A method cigarette according to claim 8 wherein the remainder of the wrapper of the cigarette extending from said first portion thereof toward the mouth end of the cigarette is treated to be non-burning.

10. A method according to claim 9 wherein said first portion of said wrapper extends approximately one-half the length of the cigarette.

11. A cigarette according to claim 8 wherein a band area extending circumferentially around the wrapper at a location adjacent said first portion of the wrapper is treated to be non-burning to provide a burning barrier adjacent the portion of the cigarette treated with said coating.

12. A method according to claim 4 in which said acid producing material is applied as a phosphoric acid solution or a sulfuric acid solution.

13. The method according to claim 4 in which said acid producing material is applied as a solution of ammonium sulfate.

14. The method according to claim 4 in which said acid producing material is applied as an aqueous solution of a lignosulfonate.

* * * * *

UNITED STATES PATENT AND TRADEMARK OFFICE

CERTIFICATE OF CORRECTION

PATENT NO. : 4,146,040

DATED : March 27, 1979

INVENTOR(S) : Charles C. Cohn

It is certified that error appears in the above-identified patent and that said Letters Patent are hereby corrected as shown below:

Column 9, line 9, "cigarette" should be deleted.

Column 10, line 1, "cigarette" should read --method--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*